US006769679B2

(12) United States Patent
Ishibashi

(10) Patent No.: US 6,769,679 B2
(45) Date of Patent: Aug. 3, 2004

(54) ROLLER, SHEET FEED APPARATUS, AND IMAGE FORMING APPARATUS

(75) Inventor: Shigehisa Ishibashi, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/408,102

(22) Filed: Apr. 8, 2003

(65) Prior Publication Data

US 2003/0193127 A1 Oct. 16, 2003

(30) Foreign Application Priority Data

Apr. 10, 2002 (JP) ..... 2002-108234

(51) Int. Cl.[7] ..... B65H 3/06

(52) U.S. Cl. ..... 271/109; 271/122; 271/125; 492/49; 492/39

(58) Field of Search ..... 271/109, 122, 271/125; 492/49, 39, 42, 43, 44

(56) References Cited

U.S. PATENT DOCUMENTS

| | | | | |
|---|---|---|---|---|
| 5,660,489 | A | 8/1997 | Ishii et al. | 400/641 |
| 5,725,209 | A | 3/1998 | Takahashi et al. | 271/122 |
| 6,038,424 | A | 3/2000 | Nakagawa | 399/367 |

FOREIGN PATENT DOCUMENTS

| | | |
|---|---|---|
| JP | 6-340343 | 12/1994 |
| JP | 7-117880 | 5/1995 |
| JP | 6-329282 | 11/1997 |
| JP | 10-316257 | 12/1998 |

*Primary Examiner*—David H. Bollinger
(74) *Attorney, Agent, or Firm*—Fitzpatrick, Cella, Harper & Scinto

(57) ABSTRACT

A roller including: an outer peripheral portion coming into contact with a sheet; an inner peripheral portion; and a plurality of connection ribs for connecting the outer peripheral portion and the inner peripheral portion to each other, in which the outer peripheral portion and the inner peripheral portion have a cylindrical configuration and are arranged concentrically, and in which the connection ribs are inclined by a predetermined angle with respect to a straight line radially extending from an axis of the roller.

15 Claims, 13 Drawing Sheets

ROLLER, SHEET FEED APPARATUS, AND IMAGE FORMING APPARATUS

BACKGROUND OF THE INVENTION

1. Field of the Invention

The present invention relates to a roller for feeding or transporting sheets, such as originals or recording paper, to an image forming apparatus, such as a copying machine, a printer, or a facsimile apparatus. The present invention also relates to a sheet feed apparatus and an image forming apparatus using this roller.

2. Related Background Art

In a sheet feed apparatus for feeding sheets, such as recording paper or originals, it is necessary to supply contained sheets one by one. For this purpose, there is available, for example, a retard separation type sheet feed apparatus 201 shown in FIG. 11 for feeding sheets one by one.

The sheet feed apparatus 201 shown in FIG. 11 is equipped with a pick-up roller 205 for feeding a plurality of sheets from a sheet containing device 203, in which a plurality of sheets are stacked on a stack table (not shown), one by one starting with the uppermost sheet 202, a feed roller 206 for feeding the sheet 202, fed from the sheet containing device 203 by the pick-up roller 205, into an image forming apparatus main body (in the direction indicated by the arrow "b" in the FIG. 11), a retard roller 207 which is opposed to the feed roller 206 and which, when a plurality of sheets are fed from the sheet containing device 203, rotates in a rotating direction reverse to the rotating direction for feeding sheets to thereby separate the plurality of sheets into a single sheet 202, and a transport roller pair 209 for transporting the separated sheet.

Further, in a sheet passage region 210 between the pick-up roller 205 and the roller set consisting of the feed roller 206 and the retard roller 207, there is arranged a guide 211. Between the roller set consisting of the feed roller 206 and the retard roller 207 and the transport roller pair 209, and between the transport roller pair 209 and the image forming apparatus main body, there are arranged guides 212, each guiding the sheet 202.

A drive transmission device 213 shown in FIG. 12 drives the feed roller 206 and the retard roller 207.

As shown in FIG. 12, in the drive transmission device 213, a feed roller shaft 215 supporting the feed roller 206, a retard roller shaft 216 supporting the retard roller 207, and a retard roller driving shaft 217 connected to the retard roller shaft 216, are arranged substantially parallel to each other. The retard roller shaft 216 is supported by an oscillatable support member (not shown) and capable of moving toward and away from the feed roller shaft 215 so as to be parallel to the same. Further, between the retard roller shaft 216 and the retard roller driving shaft 217, there are arranged a coupling 219 and a torque limiter 220. Further, at an end portion of the feed roller shaft 215, there is provided an electromagnetic clutch 222 for transmitting the driving force transmitted from a main driving unit of the image forming apparatus main body (not shown) to the feed roller shaft 215 through a drive input belt 221. Further, wrapped around the feed roller shaft 215 and the retard roller driving shaft 217 is a retard driving belt 223 for transmitting to the retard roller driving shaft 217 a rotational driving force transmitted to the feed roller shaft 215. Note that the coupling 219 serves to transmit a driving force from the retard roller driving shaft 217 to the retard roller shaft 216 even when the retard roller 207 is displaced.

The driving of the feed roller 206 and the retard roller 207 by the drive transmission device 213 will be described. The rotational driving force supplied from the main driving unit of the image forming apparatus main body (not shown) is transmitted to the drive input belt 221, and input to a pulley 225 provided on the armature portion of the electromagnetic clutch 222 ON/OFF-controlled in accordance with the sheet feed timing. Here, the feed roller shaft 215 rotating integrally with the rotor portion of the electromagnetic clutch 222 is connected to the retard roller driving shaft 217 and the retard roller shaft 216 by the retard driving belt 223, so that the feed roller shaft 215, the retard roller shaft 216, and the retard roller driving shaft 217 rotate in the same direction, and the feed roller 206 and the retard roller 207 are driven to be rotated in synchronism with each other when the sheet feed timing is ON.

When the sheets 202 are fed one by one in the sheet feeding direction (the direction indicated by the arrow "b" in FIGS. 11 and 12) by the rollers rotated by the driving force transmitted by the drive transmission unit 213, the torque limiter 220 makes idle rotation due to the frictional force between the feed roller 206 and the sheet 202, and the retard roller 207 rotates in the direction reverse to the direction in which the retard roller driving shaft 217 is driven to be rotated.

When a plurality of sheets 202 are fed, the torque limiter 220 makes no idle rotation due to the fact that the frictional force between the plurality of sheets 202 is smaller than the frictional force between the retard roller 207 and the sheets 202, and the retard roller 207 rotates in the same direction as the retard roller driving shaft 217. As a result, the sheet 202 nearest to the feed roller 206 side, that is, the uppermost sheet 202, is separated from the rest of the plurality of sheets 202, thereby preventing double feed of sheets 202 into the image forming apparatus main body. Note that, in the following, the phenomenon in which a plurality of sheets are fed from the sheet containing device to the retard roller will be referred to as "stack transport", and the phenomenon in which a plurality of sheets are allowed to be fed into the image forming apparatus main body without being separated by the retard roller will be referred to as "double feed".

Next, theoretical formulas satisfying the conditions for the feeding and separation of the sheets 202 by the sheet feed apparatus 201, constructed as described above, will be illustrated.

$$N>T/r\mu BP+(\mu APP\mu AP)W/\mu BP \quad (1)$$

$$N<T/r\mu BPP2\mu APPW/\mu BPP \quad (2)$$

$$N<T/r\mu CP \quad (3)$$

where $\mu$AP: the coefficient of friction between the pick-up roller 205 and the sheets 202;

$\mu$BP: the coefficient of friction between the feed roller 206 and the sheets 202;

$\mu$CP: the coefficient of friction between the retard roller 207 and the sheets 202;

$\mu$APP: the coefficient of friction between the sheets 202 under the pressure portion of the pick-up roller 205;

$\mu$BPP: the coefficient of friction between the sheets 202 at the nip portion of the feed roller 206 and the retard roller 207;

N: the pressure force of the retard roller 207;

T: the idle torque of the torque limiter 220;

r: the radius of the retard roller 207; and

W: the pressure force of the pick-up roller 205.

Formula (1) satisfies the feeding condition, formula (2) satisfies the separating condition, and formula (3) satisfies the retard roller associative rotation condition.

Note that, if the sheets used in the above formulas are the same, there is no great variation in coefficient of friction between the roller pressure portions, so that through the substitution: $\mu APP \approx \mu BPP = \mu PP$, the following formulas (4) and (5) are obtained from formulas (1) and (2):

$$N > T/r\mu BP + (\mu PP - \mu AP)W/\mu BP \quad (4)$$

$$N < T/r\mu PP - 2W \quad (5)$$

FIG. 13 is a graph showing the relationship between the above formulas (3), (4) and (5), using the pressure force N of the retard roller 207 and the idle torque T of the torque limiter 220 as parameters.

In FIG. 13, the shaded portion indicates the feed region.

Thus, to enlarge the shaded region, it is necessary either to increase the coefficient of friction between the rollers and sheets or to reduce the pressure force of the pick-up roller 205. Further, it can be understood that the feed region is enlarged by setting the feeding condition such that both the pressure force N of the retard roller 207 and the idle torque T of the torque limiter 220 increase (upper right in FIG. 13).

JP 07-117880 A proposes a novel technique for enlarging the feed region, which helps to markedly improve the separation performance for the sheets stack-transported from the sheet containing device. According to this revolutionary technique, the retard roller is formed of a resilient material like sponge, and the nip configuration of the press-contact portion between the feed roller and the retard roller is concave toward the retard roller side, whereby it is possible to achieve the following three advantages, which are not to be attained with the conventional retard roller of synthetic rubber.

(1) An improvement in stack sheet separation ability is achieved due to the enlargement of the nip width.

(2) By forming the roller of a resilient material, the chattering noise from the roller and fluttering of the separated sheet during separating operation are eliminated.

(3) Due to the reduction in the requisite torque for the torque limiter, the roller service life is elongated, and skew feed is mitigated.

However, even a retard roller formed of a resilient material like sponge, which is ideal as far as the separation performance is concerned, involves the following problems.

Due to its characteristics, a sponge material is never free from permanent set. Thus, if the retard roller, which is constantly in press contact with the feed roller, is left as it is for a long period of time, in particular, in a high-temperature/high-humidity environment, it becomes rather difficult for the concave nip portion to be restored to the original substantially round configuration. Then, the concave-portion-radius of the retard roller as compared with that in the other phase is reduced, with the result that the stack sheet return force in the roller-periphery-tangential direction increases. While this is a phenomenon advantageous from the viewpoint of stack sheet separation, it involves an increase in the associative rotation resistance of the retard roller when the sheets are fed one by one, so that damage to the feed roller is accumulated, causing feed slip (feed jam) to occur frequently. Further, in the above-mentioned conventional technique, coating is effected on the outer peripheral surface of the sponge base material to thereby maintain the requisite strength of the surface layer, which means the roller in itself is rather expensive as compared with one formed of synthetic rubber.

In view of the above problems, JP 06-329282 A, JP 06-340343 A, JP 10-316257 A, etc. disclose techniques according to which a hollow retard roller of synthetic rubber is used and of which the same effect as that of the retard roller of sponge is to be expected. However, in these techniques, a roller side wall supporting the roller outer peripheral portion in contact with the sheet is present on either side, so that the nip configuration in the roller press-contact portion is flat, which means it is rather difficult to realize a concave configuration in conformity with the outer peripheral surface of the feed roller.

SUMMARY OF THE INVENTION

In view of the above problems in the conventional art, it is an object of the present invention to provide a sheet feed apparatus which adopts an inexpensive roller construction in which the permanent set in the roller press-contact portion is mitigated, making it possible to maintain for a long period of time the stack sheet separation performance as obtained with a resilient retard roller formed of a sponge material or the like.

According to the present invention, there is provided a roller including:

an outer peripheral portion coming into contact with a sheet;

an inner peripheral portion; and a plurality of connection ribs for connecting the outer peripheral portion and the inner peripheral portion to each other, in which the outer peripheral portion and the inner peripheral portion have a cylindrical configuration and are arranged concentrically, and in which the connection ribs are inclined by a predetermined angle with respect to a straight line radially extending from an axis of the roller.

According to the present invention, there is provided a sheet feed apparatus including:

sheet containing means for containing and supporting sheets;

sheet feeding means for feeding sheets from the sheet containing means; and a retard separation mechanism for feeding the sheets from the sheet feeding means separately one by one, in which the retard separation mechanism has a feed roller rotating in the direction in which the sheets are fed and a retard roller in press contact with the feed roller and rotating in the direction in which the sheets are returned to the sheet containing means, and in which the retard roller has an outer peripheral portion coming into contact with the sheets, an inner peripheral portion, and a plurality of connection ribs for connecting the outer peripheral portion and the inner peripheral portion to each other, the outer peripheral portion and the inner peripheral portion being of a cylindrical configuration and arranged concentrically, the connection ribs being inclined by a predetermined angle with respect to a straight line extending radially from the axis of the retard roller.

DESCRIPTION OF THE PREFERRED EMBODIMENTS

Figure 10:
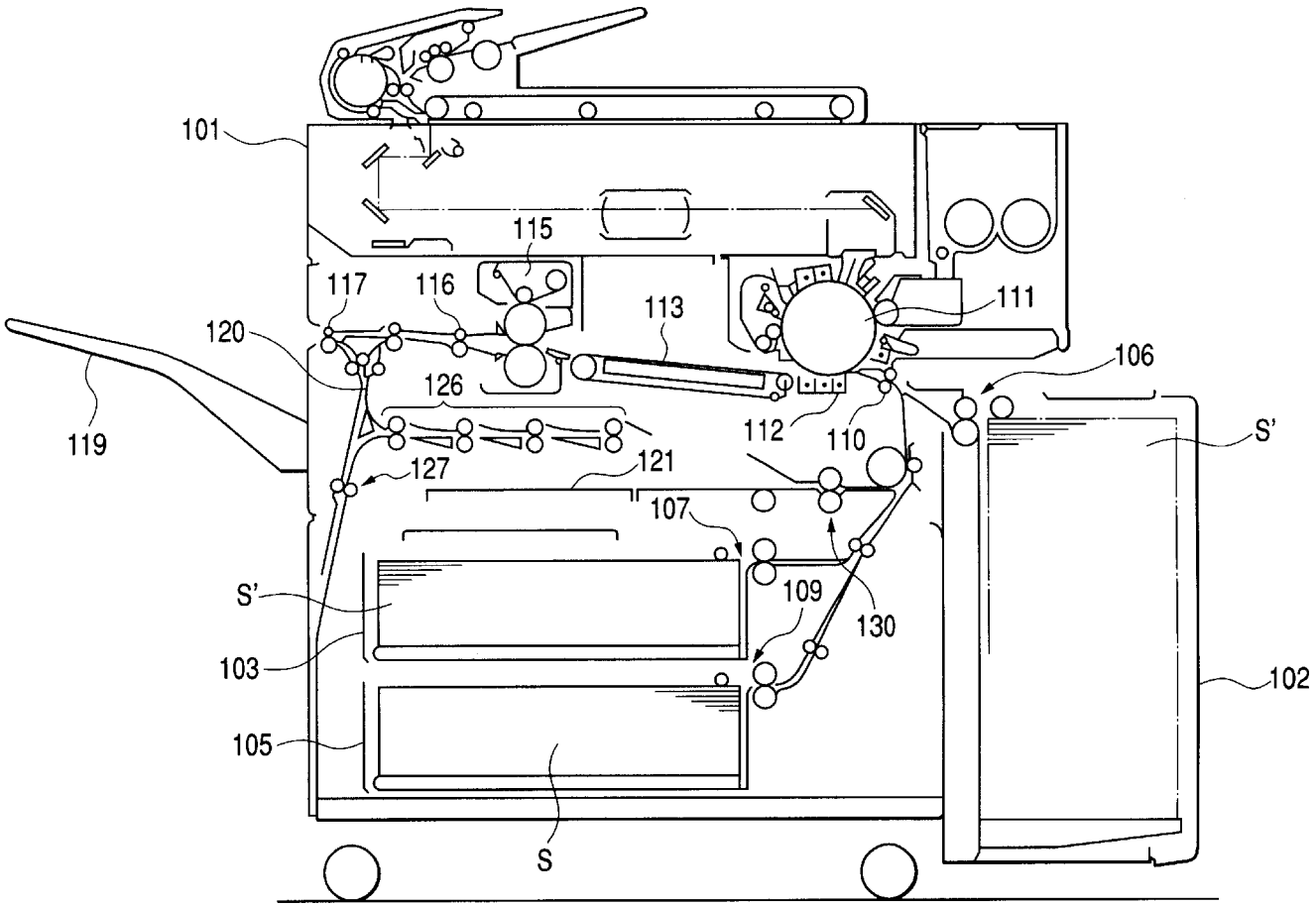
FIG. 10 is a sectional view of an image forming apparatus main body in which a sheet feed apparatus according to the present invention is mounted.
Figure 11:
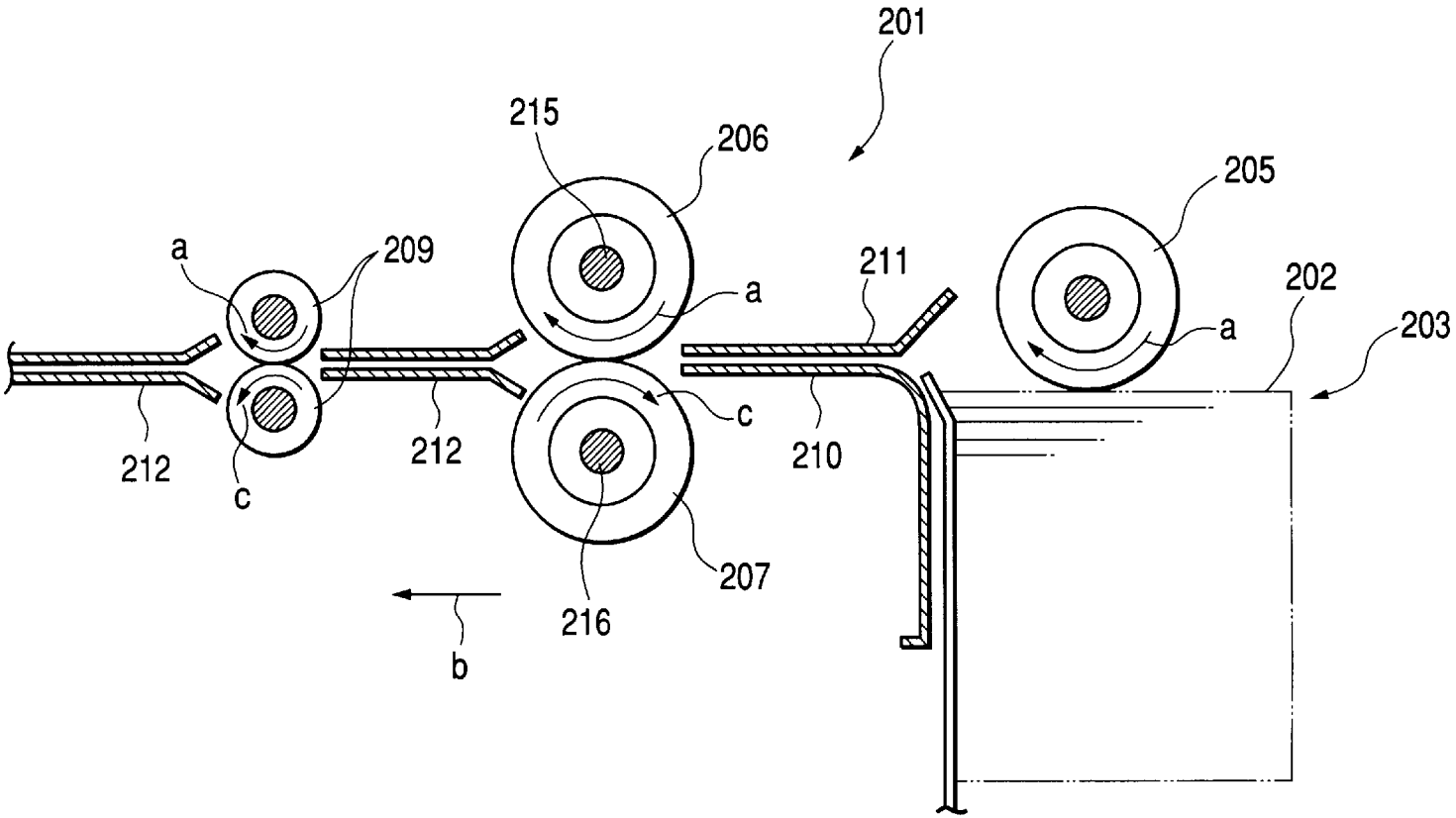
FIG. 11 is a sectional view of a conventional sheet feed apparatus.
Figure 12:
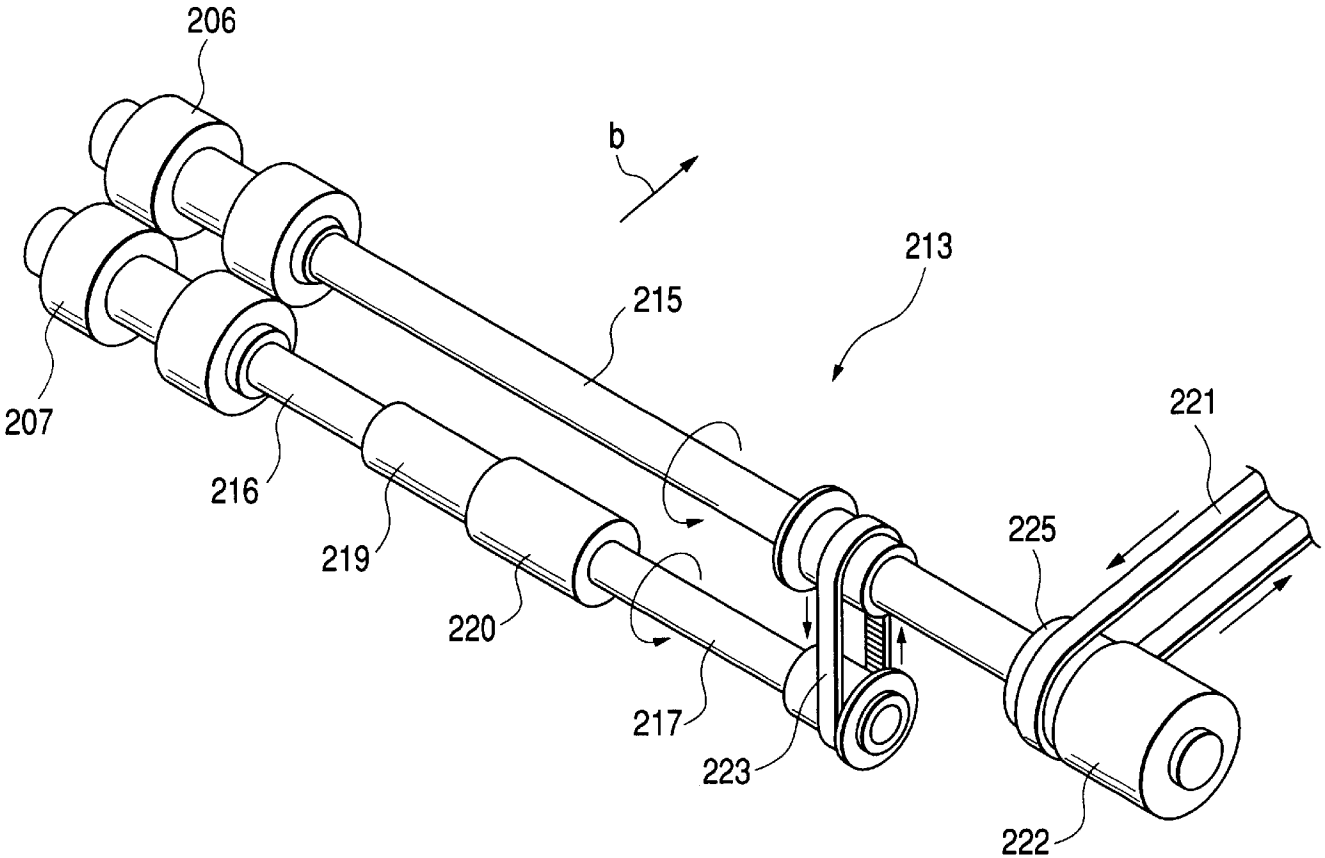
FIG. 12 is a perspective view of the conventional sheet feed apparatus.
Figure 13:
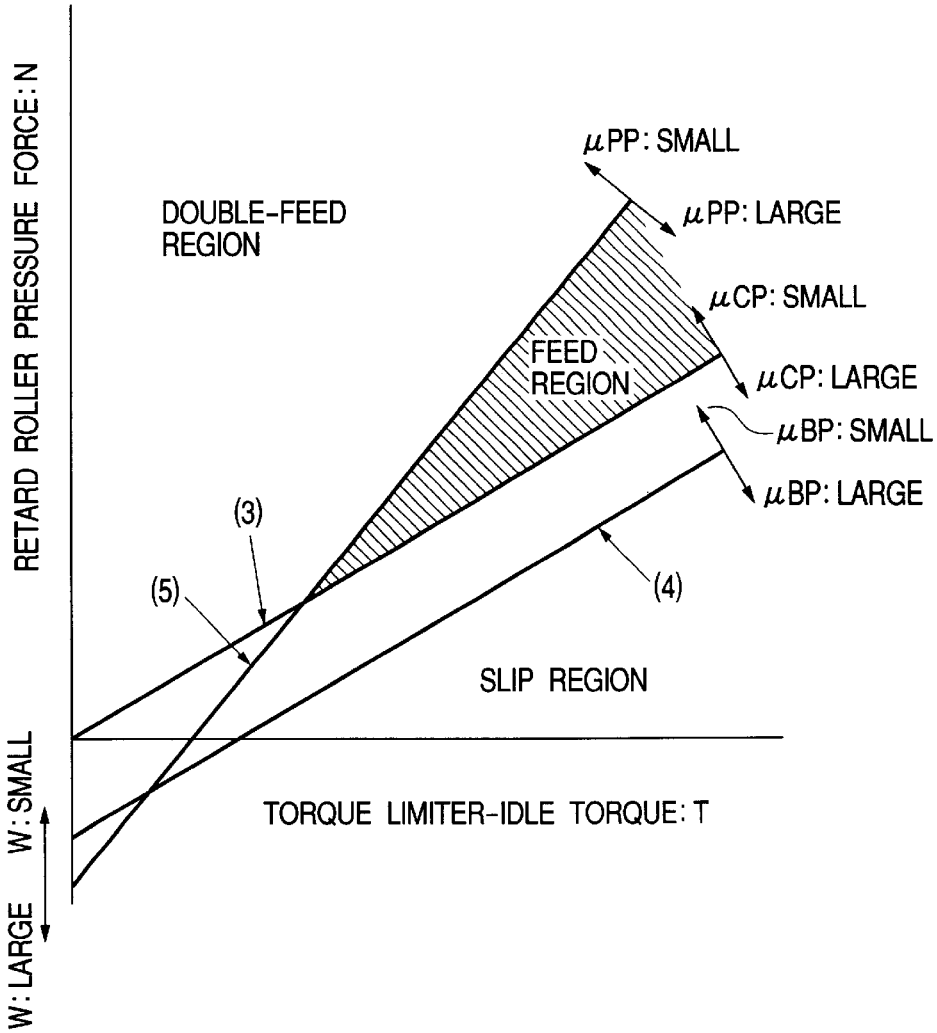
FIG. 13 is a diagram showing a feed region in a retard separation system.

First, FIG. 10 shows an image forming apparatus in which a sheet feed apparatus according to the present invention is mounted. This image forming apparatus has an image forming apparatus main body 101 having on one side thereof a sheet feed deck 102 in which a large amount of sheets S' are stacked. Further, in the lower portion of the interior of the image forming apparatus main body 101, there are provided a plurality of sheet feed cassettes 103 and 105 in which a predetermined amount of sheets S' are stacked.

Then, retard separation type sheet feed apparatuses 106, 107, and 109 are provided respectively at the positions where there are installed the sheet feed deck 102 serving as the sheet feed portion for feeding the sheets S', and the sheet feed cassettes 103 and 105.

When sheet feeding is performed by the sheet feed apparatuses 106, 107, and 109, the sheets S' in the sheet feed deck 102 and the sheet feed cassettes 103 and 105 are first fed to a registration roller pair 110, which stops rotation to allow entrance of the sheets, and any skew feed is corrected.

Next, each sheet is fed to the gap between a photosensitive drum 111 and a transfer charger 112 by the registration rollers 110 rotating in synchronism with a latent image formed on the photosensitive drum 111, and at this gap, a toner image on the photosensitive drum 111 is transferred to the sheet (image formation).

Thereafter, the sheet S' is transported to a fixing device (fixing roller pair) 115 by a transport belt 113 to undergo fixing processing for fixing the transferred toner image to the sheet surface.

This image forming apparatus is endowed with a two-side copying mode in which copying is performed on both sides of the sheet S' and a multi copying mode in which multi copying is performed. In the normal copying mode, the sheets S' which have undergone fixing processing are delivered onto a delivery tray 119 outside the apparatus by an inner delivery roller pair 117.

In the two-side copying mode and the multi copying mode, the sheets are transported through a re-feed path 120 and a duplex transport path 126 by an inner delivery roller pair 116 or a switch back roller pair 127 to be temporarily stacked on an intermediate tray 121 for accommodation.

Then, the sheets S' contained on the intermediate tray 121 are transported again to the registration roller pair 110 for image formation by a sheet re-feed device 130 and, after a process which is the same as one-side copying, they are delivered to the exterior of the apparatus.

The retard separation type sheet feed apparatuses 106, 107, and 109 provided at the positions where the sheet feed deck 102 and the sheet feed cassettes 103 and 105 are installed are substantially of the same construction as the conventional sheet feed apparatus 201 except for the roller construction. Next, the roller construction peculiar to the present invention will be described in detail.

Embodiment 1

In the following, a first embodiment of the roller used in the sheet feed apparatus of the present invention will be described with reference to the drawings.

Figure 1A:
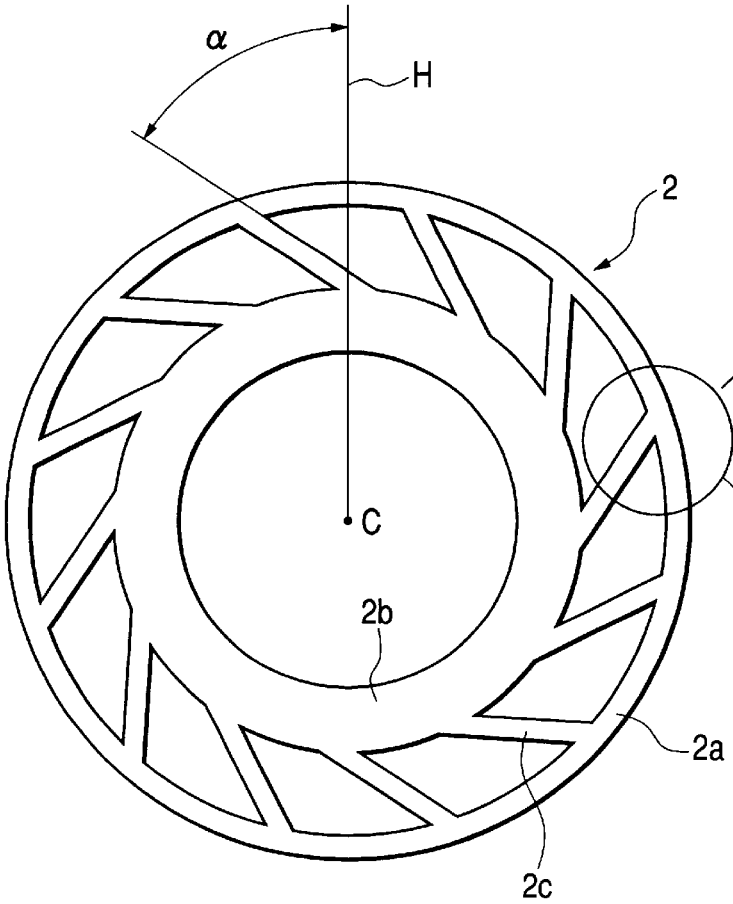
FIG. 1A is a sectional view of a roller according to a first embodiment of the present invention.
Figure 1B:
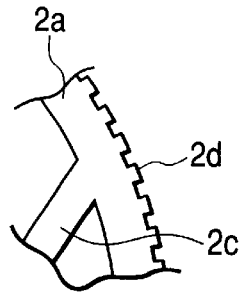
FIG. 1B is an enlarged view of an encircled portion IB in FIG. 1A.
Figure 2:
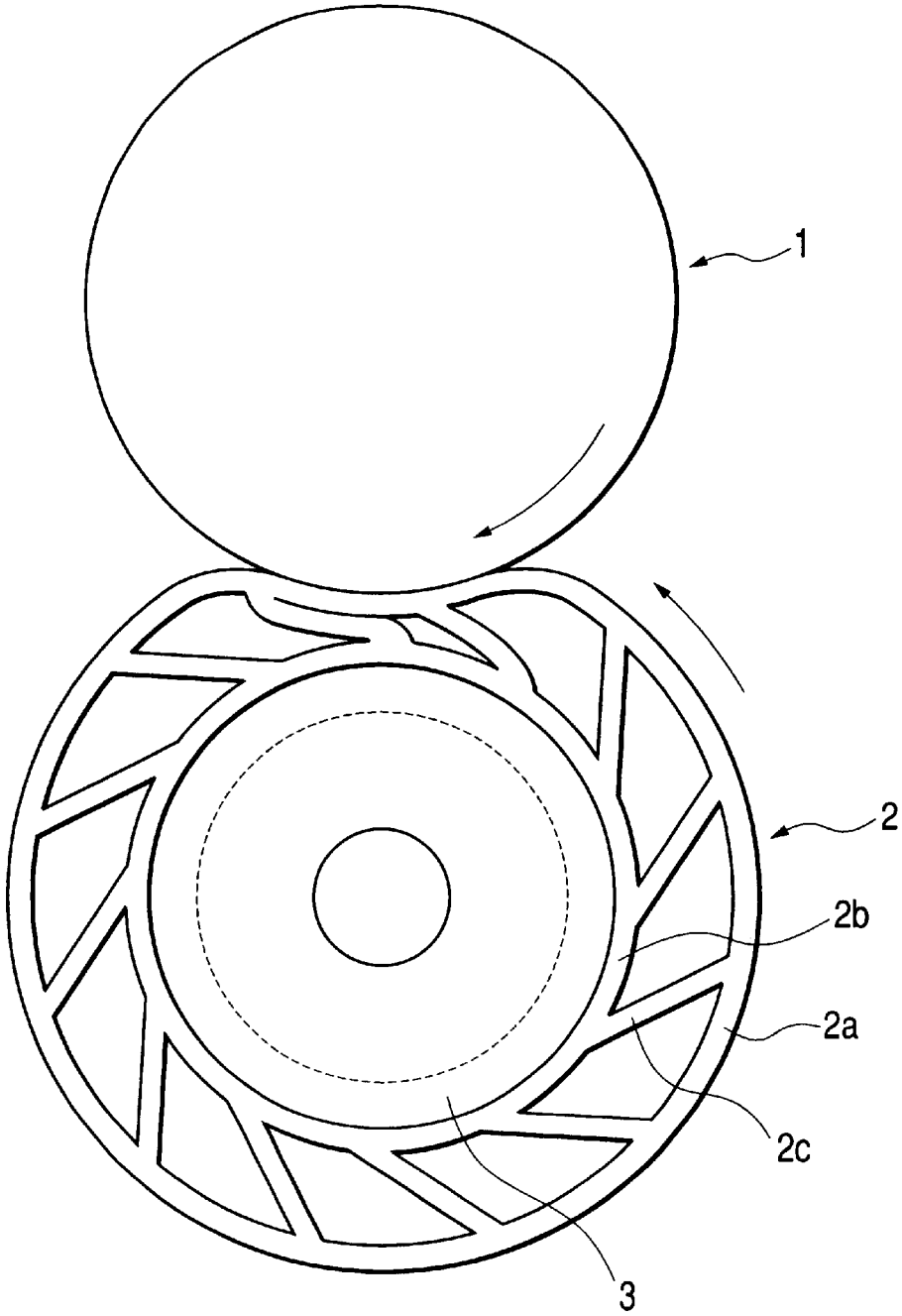
FIG. 2 is a sectional view showing a sheet feed apparatus using the roller shown in FIG. 1A.

FIGS. 1A, 1B, and 2 are schematic diagrams showing the features of the present invention most clearly. In FIGS. 1A, 1B, and 2, numeral 1 indicates a feed roller, numeral 2 indicates a retard roller, and numeral 3 indicates a retard roller core fixed to the retard roller shaft to which drive is transmitted. The feed roller 1 and the retard roller 2 are formed of synthetic rubber such as EPDM or silicone rubber.

As shown in FIG. 1A, the retard roller 2 is composed of an outer peripheral portion 2*a*constituting the surface coming into contact with the sheets, an inner peripheral portion 2*b* in press fit engagement with the retard roller core 3, and a plurality of connection ribs 2*c* connecting the outer peripheral portion 2*a* and the inner peripheral portion 2*b* with each other. As shown in FIG. 1, the connection ribs 2*c* are inclined by a predetermined angle $\alpha$ with respect to a straight line H extending radially from the axis (shaft center) C of the retard roller 2. Therefore, the connection ribs 2*c* define voids between themselves, so that they are capable of deformation through deflection.

Figure 3:
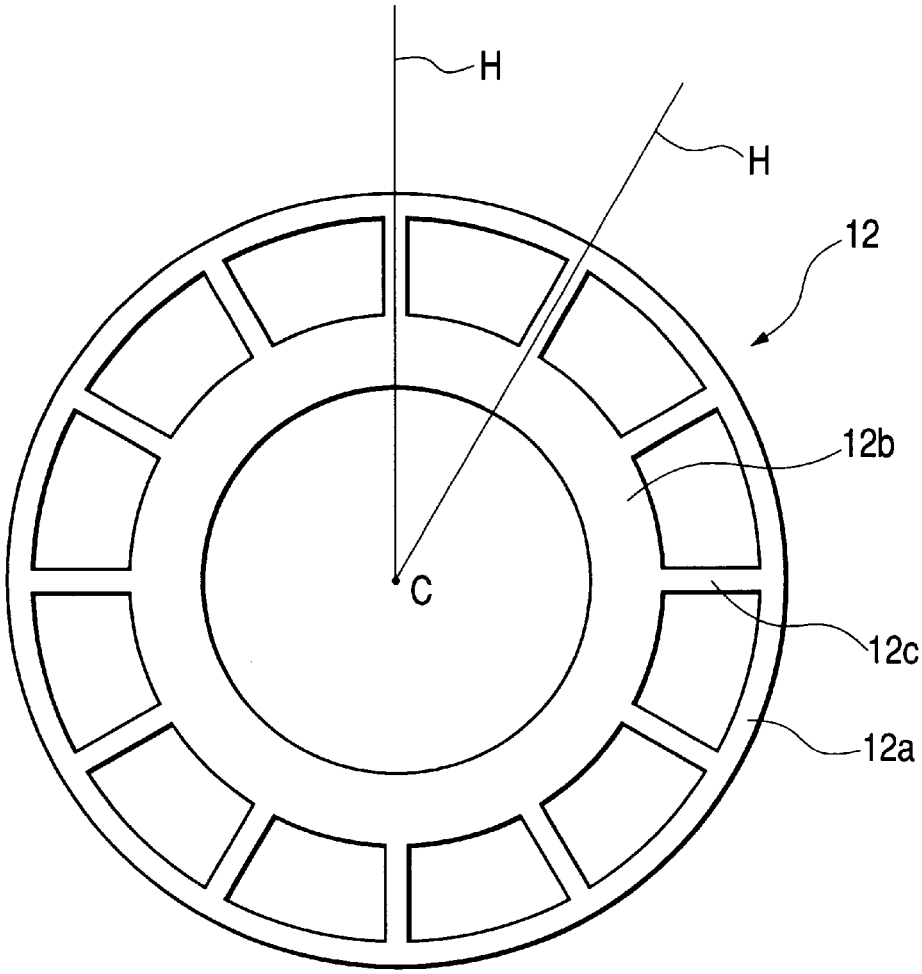
FIG. 3 is a sectional view for illustrating a functional superiority of the roller shown in FIG. 1A.

The effect of the angle $\alpha$ of the connection ribs 2*c* will be illustrated in comparison with the case of a retard roller 12 shown in FIG. 3 in which the angle $\alpha=0°$, that is, all the connection ribs extend in the same direction as the straight line H extending radially from the axis C of the retard roller.

Figure 4:
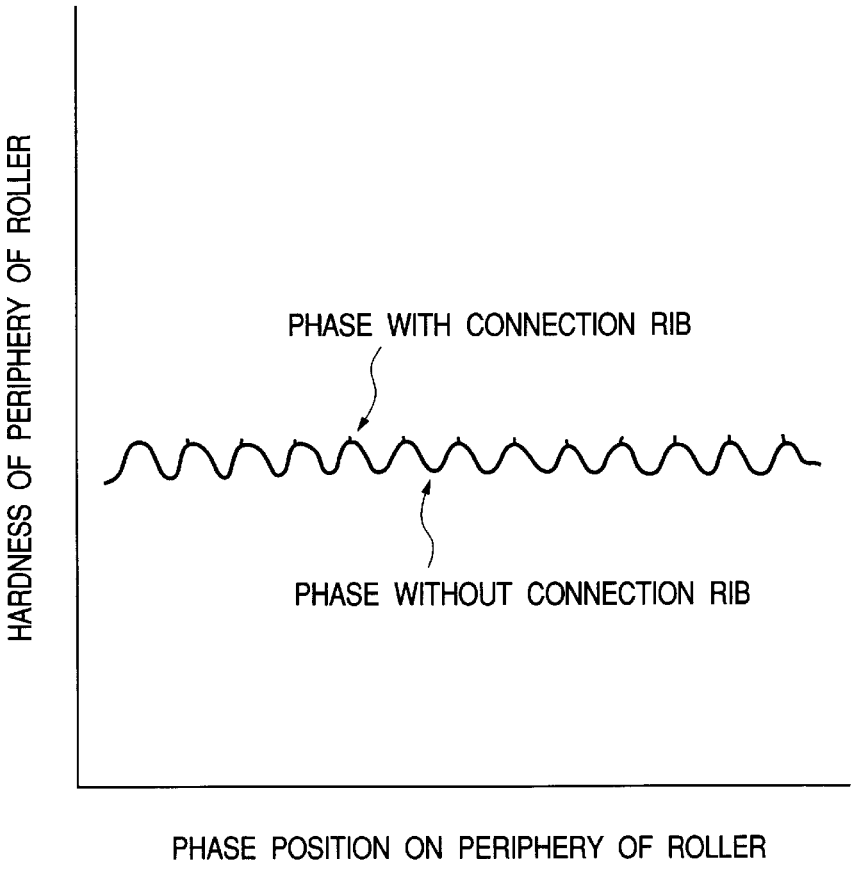
FIG. 4 shows a relationship between a phase position on periphery and hardness of periphery of the roller shown in FIG. 3.

The retard roller 12 shown in FIG. 3 is composed of an outer peripheral portion 12*a* constituting the surface coming into contact with the sheets, an inner peripheral portion 12*b* in press fit engagement with the retard roller core 3, and a plurality of connection ribs 12*c* connecting the outer peripheral portion 12*a* and the inner peripheral portion 12*b* with each other. FIG. 4 shows the circumferential distribution of the radial static hardness of the retard roller shown in FIG. 3 (reduced value obtained from the roller crush amount when the roller outer peripheral portion is radially pressurized with a predetermined force).

As is apparent from FIG. 4, in the retard roller shown in FIG. 3, the connection-rib-phase portion is hard, and the other phase portion is soft, thus exhibiting large variation in hardness in the roller circumferential direction.

Figure 5:
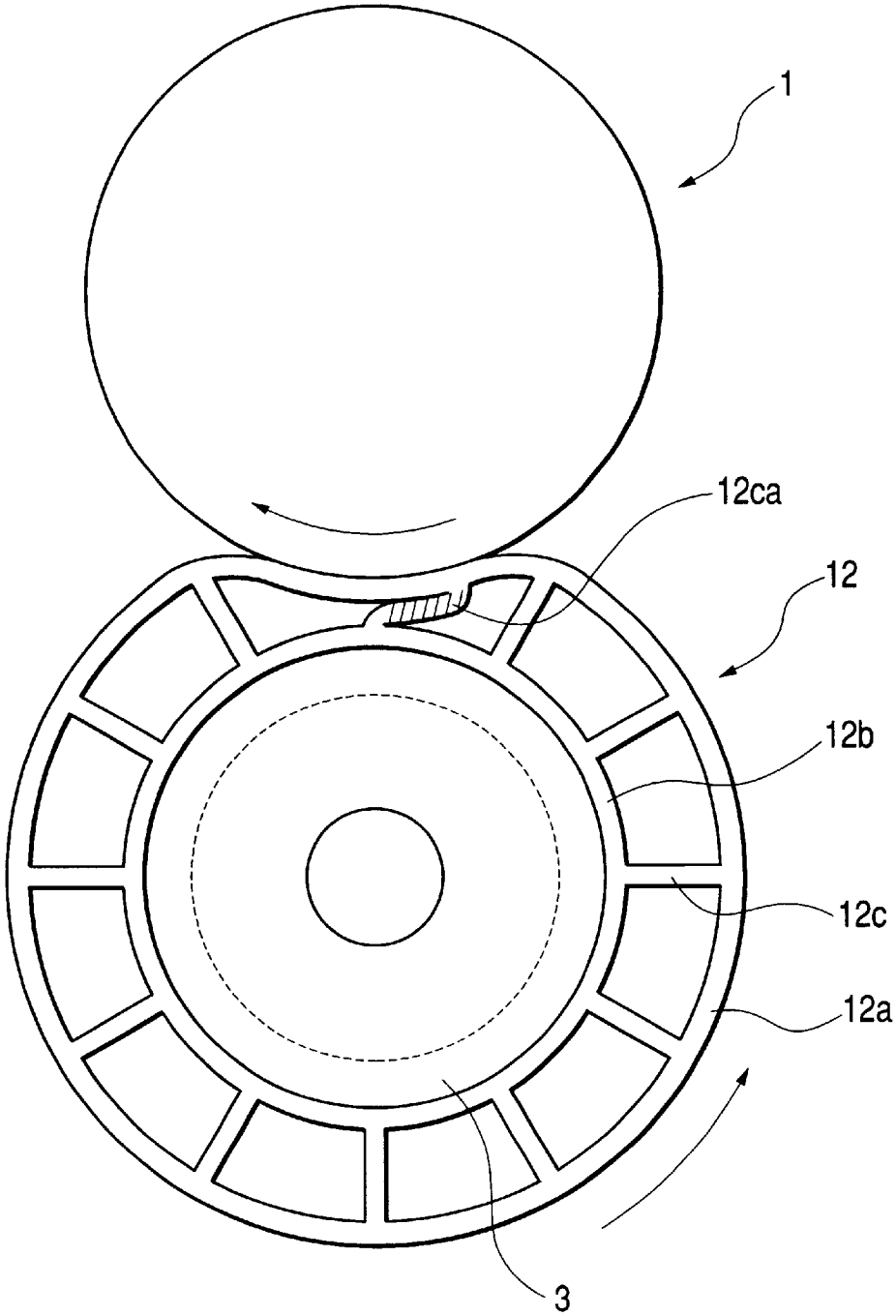
FIG. 5 is a sectional view illustrating a functional superiority of the sheet feed apparatus using the roller shown in FIG. 3.
Figure 6:
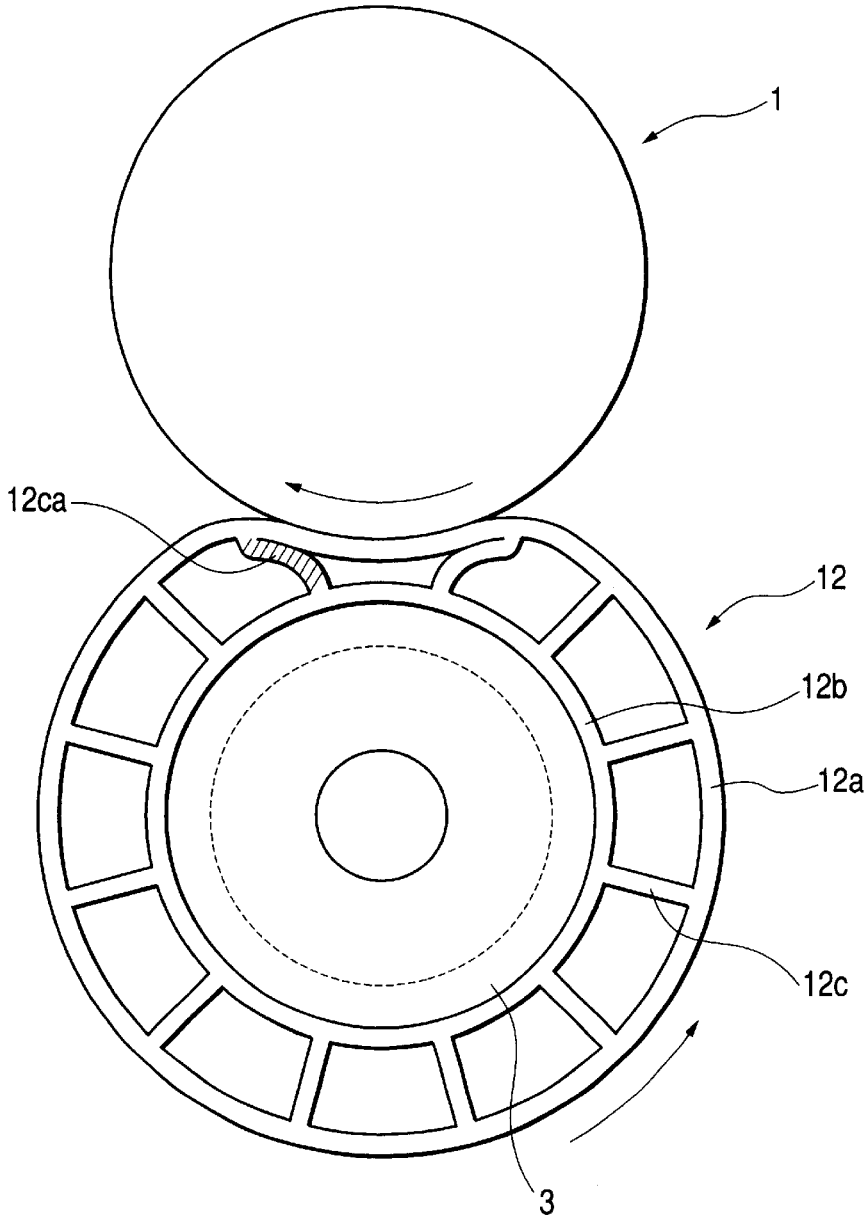
FIG. 6 is a sectional view illustrating the functional superiority of the sheet feed apparatus using the roller shown in FIG. 3.
Figure 7:
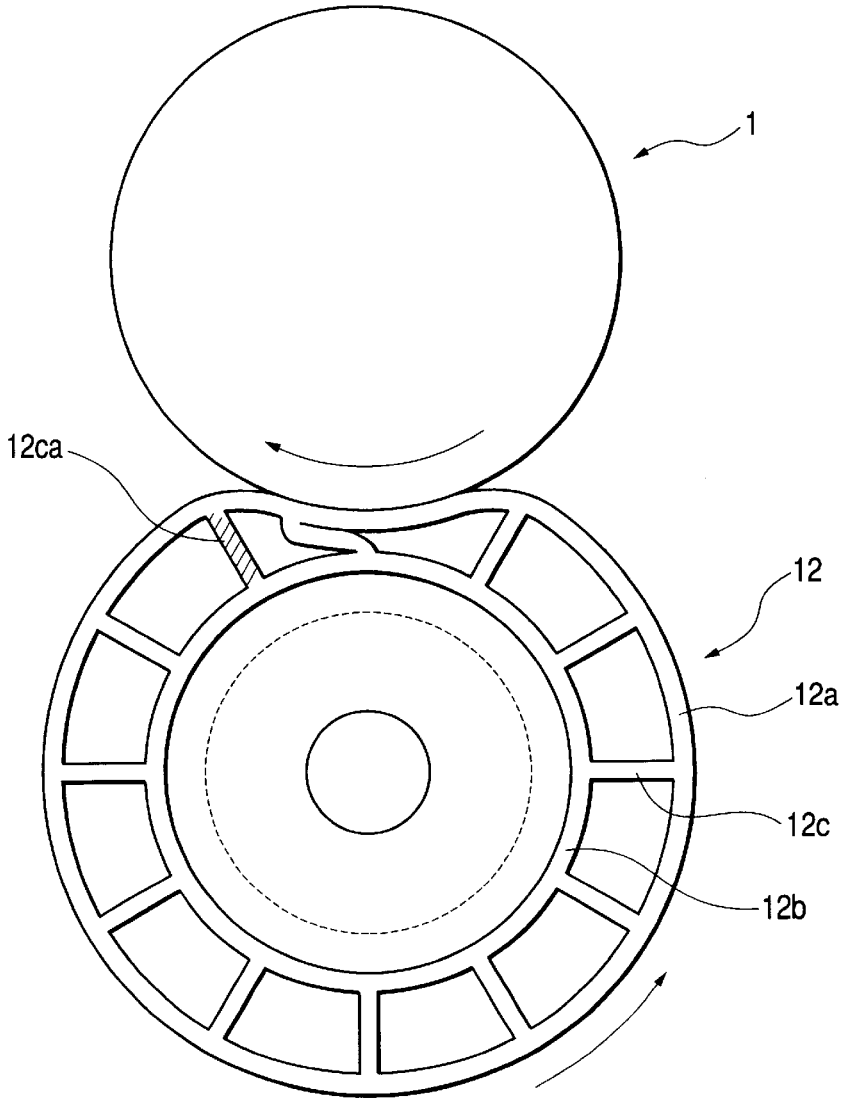
FIG. 7 is a sectional view illustrating the functional superiority of the sheet feed apparatus using the roller shown in FIG. 3.

FIGS. 5, 6, and 7 show a behavior of the connection ribs of the retard roller shown in FIG. 3 during the actual sheet transport operation of the retard roller. As shown in FIGS. 5, 6, and 7, the connection rib 12*ca*, which undergoes clockwise deformation in the state shown in FIG. 5, undergoes transition to counterclockwise deformation as the retard roller rotates from the state of FIG. 6 to that of FIG. 7. At the moment of transition, the connection rib climbs over the center of the concave nip portion, when the hardness of the roller in the radial direction reaches its peak.

Further, the base portions of the connection ribs 12*c*, which are in the vicinity of the inner peripheral portion, continue to alternately receive stress to the right and left, so that the roller is subject to wear-out due to stress fatigue of the base portions of the connection ribs (which means the roller hardness is reduced). In view of this problem, according to this embodiment, the connection ribs are inclined by a predetermined angle $\alpha$ with respect to the straight line H radially extending from the axis C of the retard roller. Due to the inclination by the angle $\alpha$, the direction in which the connection ribs fall is fixed, and the center of the nip portion is not climbed over by the connection rib, so that the hardness of the connection rib phase portion of the roller surface layer is mitigated, whereby the circumferential hardness of the roller is made as uniform as possible. Further, since the base portions of the connection ribs only suffer mild stress in one direction, the stress fatigue is mitigated, thereby maintaining an optimum roller hardness for a long period of time.

Here, the optimum value of the above-mentioned angle $\alpha$ made by the connection ribs and the straight line H radially extending from the axis C of the retard roller varies depending upon the hardness of the synthetic rubber base material adopted. Experiment results show that no functional problem is involved when the angle is set at a value ranging from 10° to 80°. Further, in this embodiment, the connection ribs exhibit directivity as shown in the drawings, so that it is desirable to adjust the direction of the connection ribs with respect to the roller rotating direction as shown in FIG. 2. However, from the viewpoint of rubber molding, this embodiment provides high productivity due to the simple configuration of the connection ribs.

Note that, in this embodiment, it is also possible, as shown in FIG. 1B, to form the outer peripheral surfaces of the feed roller 1 and the retard roller 2 coming into contact with the sheets in a knurled configuration 2*d* by forming grooves therein at fixed intervals in the roller axial direction or provide fine surface irregularities through polishing. By thus providing protrusions and recesses on the outer peripheral surfaces of the rollers, it is advantageously possible to remove paper dust adhering to the outer peripheral surfaces of the rollers, and it is also possible to achieve a further improvement in roller durability (i.e., to maintain the frictional transport force of the rollers for a long period of time).

Embodiment 2

In the following, a second embodiment of the present invention will be described with reference to the drawings.

Figure 8:
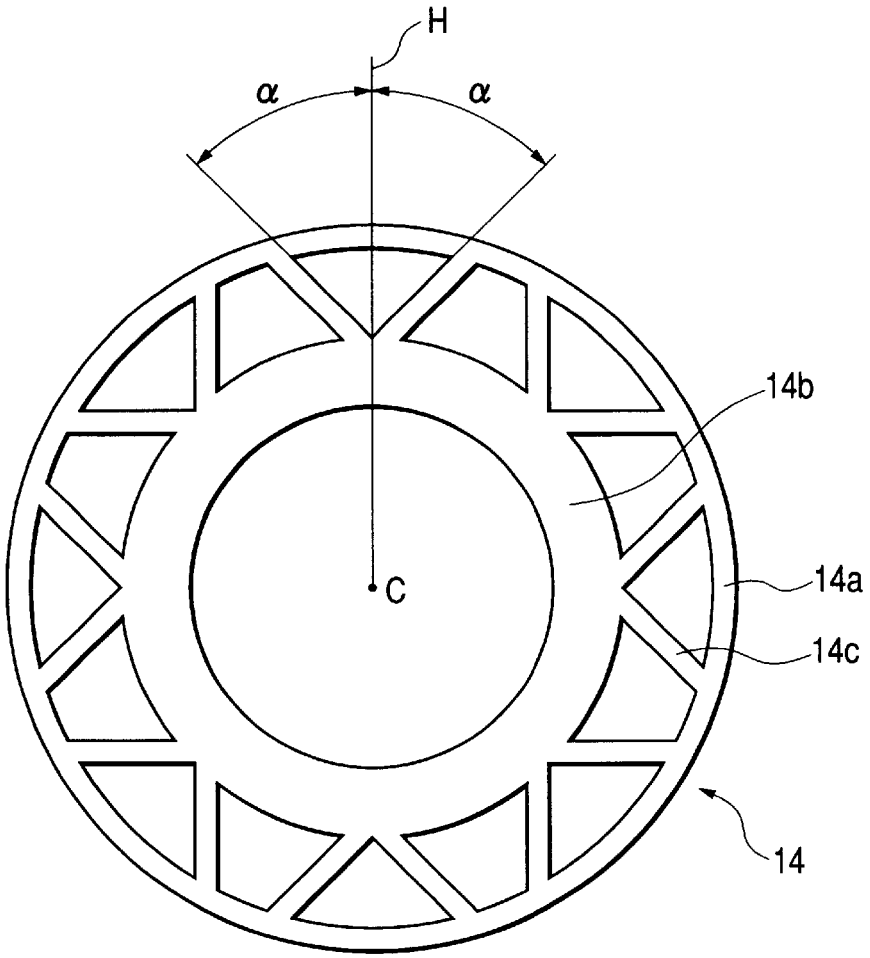
FIG. 8 is a sectional view showing a roller according to a second embodiment of the present invention.
Figure 9:
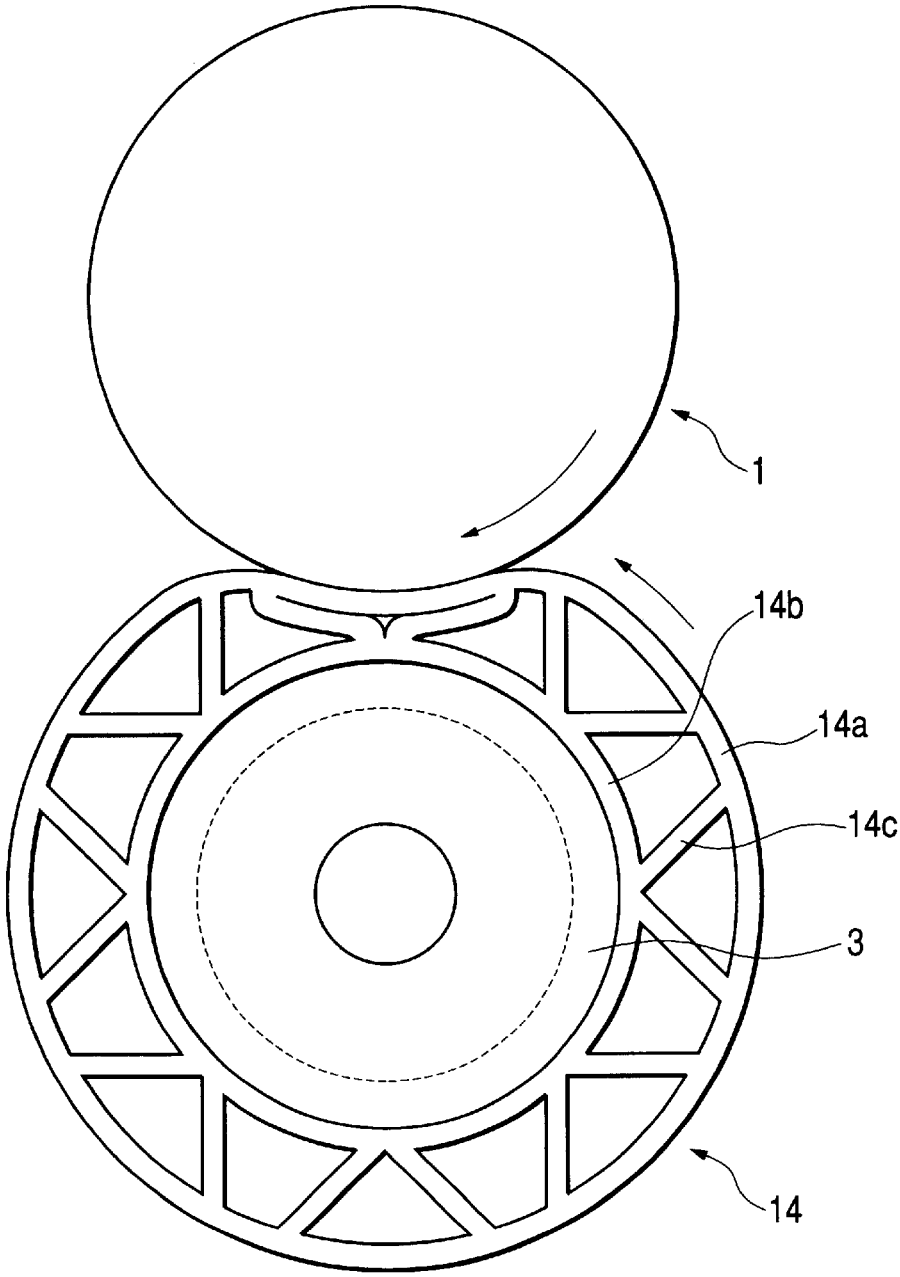
FIG. 9 is a sectional view showing an embodiment of the sheet feed apparatus using the roller shown in FIG. 8.

FIGS. 8 and 9 are schematic diagrams showing the features of the second embodiment of the present invention most clearly.

In FIGS. 8 and 9, numeral 1 indicates a feed roller, numeral 14 indicates a retard roller, and numeral 3 indicates a retard roller core. Similarly to the first embodiment, the feed roller 1 and the retard roller 14 are formed of synthetic rubber such as EPDM or silicone rubber.

As shown in FIG. 8, the retard roller 14 is composed of an outer peripheral portion 14*a* constituting the surface coming into contact with the sheets, an inner peripheral portion 14*b* in press fit engagement with the retard roller core 3, and a plurality of branched connection ribs 14*c* connecting the outer peripheral portion 14*a* and the inner peripheral portion 14*b* with each other. As shown in FIG. 8, the connection ribs 14*c* are arranged symmetrically with an angle $\alpha$ with respect to a straight line H extending radially from the axis C of the retard roller 14. The reason why the connection ribs 14*c* have the angle $\alpha$ is the same as that of the first embodiment, and therefore the description is omitted here.

An effect peculiar to this embodiment is that the retard roller involves no mounting directivity due to the symmetrical arrangement of the connection ribs.

As described above, in accordance with the present invention, a high stack sheet separation performance to be obtained by using a resilient roller formed of sponge or the like as the retard roller can be achieved with the conventional synthetic resin, whereby it is possible to provide a high durability resilient roller with reduced permanent set at low cost.

While in this embodiment the roller of the present invention is applied to the retard roller of the retard separation system, this should not be construed restrictively. The present invention is applicable to any type of roller as long as it requires a large deflection amount.

What is claimed is:

1. A roller comprising:

an outer peripheral portion coming into contact with a sheet;

an inner peripheral portion; and a plurality of connection ribs for connecting the outer peripheral portion and the inner peripheral portion to each other, wherein the outer peripheral portion and the inner peripheral portion have a cylindrical configuration and are arranged concentrically, and wherein the connection ribs are inclined by a predetermined angle with respect to a straight line radially extending from an axis of the roller.

2. A roller according to claim 1, wherein the connection ribs each are arranged so as to have the same angle with respect to the straight line radially extending from the axis of the roller.

3. A roller according to claim 1, wherein the connection ribs adjacently provided are arranged so as to be inclined in directions symmetrical with each other with respect to the straight line radially extending from the axis of the roller.

4. A roller according to claim 1, wherein the connection ribs and the radially extending straight line form the angle in a range of from 10° to 80°.

5. A roller according to claim 1, wherein the roller is formed of a synthetic rubber such as EPDM or silicone rubber.

6. A roller according to claim 1, wherein the outer peripheral portion of the roller coming into contact with the sheet has protrusions and recesses.

7. A sheet feed apparatus comprising:

sheet containing means for containing and supporting sheets;

sheet feeding means for feeding sheets from the sheet containing means; and a retard separation mechanism for feeding the sheets from the sheet feeding means separately one by one, wherein the retard separation mechanism has a feed roller rotating in a direction in which the sheets are fed and a retard roller in press contact with the feed roller and rotating in a direction in which the sheets are returned to the sheet containing means, and wherein the retard roller has an outer peripheral portion coming into contact with the sheet, an inner peripheral portion, and a plurality of connection ribs for connecting the outer peripheral portion and the inner peripheral portion to each other, the outer peripheral portion and the inner peripheral portion being of a cylindrical configuration and arranged concentrically, the connection ribs being inclined by a predetermined angle with respect to a straight line extending radially from the axis of the retard roller.

8. A sheet feed apparatus according to claim 7, wherein the connection ribs each are arranged so as to have the same angle with respect to the straight line radially extending from the axis of the roller.

9. A sheet feed apparatus according to claim 7, wherein the plurality of connection ribs are inclined in different directions with respect to the radially extending straight line.

10. A sheet feed apparatus according to claim 9, wherein the connection ribs adjacently provided are arranged so as to be inclined in directions symmetrical with each other with respect to the straight line radially extending from the axis of the roller.

11. A sheet feed apparatus according to claim 7, wherein the connection ribs and the radially extending straight line form the angle in a range of from 10° to 80°.

12. A sheet feed apparatus according to claim 7, wherein the retard roller is formed of a synthetic rubber such as EPDM or silicone rubber.

13. A sheet feed apparatus according to claim 7, wherein the feed roller and the retard roller are constructed such that a portion where the retard roller and the feed roller are in press contact with each other exhibits a nip configuration concave toward the retard roller.

14. A sheet feed apparatus according to claim 7, wherein the outer peripheral surface of the retard roller coming into contact with the sheet has protrusions and recesses.

15. An image forming apparatus comprising:

sheet containing means for containing and supporting sheets;

sheet feeding means for feeding sheets from the sheet containing means;

a retard separation mechanism for feeding the sheets from the sheet feeding means separately one by one; and image forming means for forming an image on a sheet separated by the retard separation mechanism, wherein the retard separation mechanism has a feed roller rotating in a direction in which the sheets are fed and a retard roller in press contact with the feed roller and rotating in a direction in which the sheets are returned to the sheet containing means, and wherein the retard roller has an outer peripheral portion coming into contact with the sheet, an inner peripheral portion, and a plurality of connection ribs for connecting the outer peripheral portion and the inner peripheral portion to each other, the outer peripheral portion and the inner peripheral portion being of a cylindrical configuration and arranged concentrically, the connection ribs being inclined by a predetermined angle with respect to a straight line extending radially from the axis of the retard roller.

* * * * *

UNITED STATES PATENT AND TRADEMARK OFFICE

CERTIFICATE OF CORRECTION

PATENT NO. : 6,769,679 B2
DATED : August 3, 2004
INVENTOR(S) : Shigehisa Ishibashi It is certified that error appears in the above-identified patent and that said Letters Patent is hereby corrected as shown below:

Column 5,
Line 44, “amount” should read -- number --.
Line 44, “are” should read -- is --.

Column 6,
Line 36, “2aconstituting” should read -- 2a constituting --.

Signed and Sealed this

Twelfth Day of October, 2004

JON W. DUDAS
*Director of the United States Patent and Trademark Office*